US009177734B2

(12) United States Patent
Todd

(10) Patent No.: US 9,177,734 B2
(45) Date of Patent: Nov. 3, 2015

(54) PROTECTIVE SWITCH COVER SYSTEM

(76) Inventor: Mark Todd, Jacksonville, FL (US)

( * ) Notice: Subject to any disclaimer, the term of this patent is extended or adjusted under 35 U.S.C. 154(b) by 0 days.

(21) Appl. No.: 13/564,094

(22) Filed: Aug. 1, 2012

(65) Prior Publication Data

US 2014/0291132 A1 Oct. 2, 2014

(51) Int. Cl.
*H01H 13/04* (2006.01)
*H01H 19/04* (2006.01)
*H01H 9/02* (2006.01)

(52) U.S. Cl.
CPC ..... *H01H 9/02* (2013.01)

(58) Field of Classification Search
CPC ..... H01H 9/00; H01H 9/0207; H01H 9/02
USPC ..... 200/333, 334, 43.19, 43.22, 43.16, 200/43.14, 43.11; 174/66, 67; D8/350, 353
See application file for complete search history.

(56) References Cited

U.S. PATENT DOCUMENTS 2,141,936 A * 12/1938 Schmitt ..... 200/304
2,169,860 A * 8/1939 Von Hoorn ..... 70/203
4,102,471 A * 7/1978 Lore et al. ..... 220/242
4,158,116 A * 6/1979 Krueger ..... 200/43.19
4,506,120 A * 3/1985 Fleischman ..... 200/43.19
5,955,702 A * 9/1999 Grossman et al. ..... 174/66
6,563,063 B1 * 5/2003 Moore ..... 200/50.33
6,774,328 B2 * 8/2004 Adams et al. ..... 200/329
7,820,929 B2 * 10/2010 Thorp et al. ..... 200/333

* cited by examiner

*Primary Examiner* — Kyung Lee
(74) *Attorney, Agent, or Firm* — Steven R. Scott

(57) ABSTRACT

The instant invention teaches a protective cover for an electrical switch forming part of an electrical circuit having three key components: a fastening flange adapted to be secured to a cover plate for the switch, a shield portion connected to the fastening flange which serves to help block accidental contact, activation and/or access to the electrical switch, but does not totally prevent intentional movement of the switch by a user (especially via a hand-held tool), and a snap off tab or tabs forming part of the shield portion, with the snap off tab or tabs being adapted to be snapped off and removed to allow freer access to and movement of the electrical switch by a user while still providing significant protection against accidental contact and activation.

18 Claims, 10 Drawing Sheets

PROTECTIVE SWITCH COVER SYSTEM

BACKGROUND OF THE INVENTION

1. Field of the Invention

This invention pertains generally to covers and devices used to prevent the inadvertent and/or undesired activation or deactivation of light/electrical switches. More particularly, the invention pertains to a system of light/electrical switch covers that can be used to cover a switch so as to make it inaccessible, but also have snap-off portions to allow access to one or more portions of the switch and/or from one or more directions to the switch.

2. Description of the Related Art

A variety of covers and devices have been developed over the years in an attempt to prevent the inadvertent and/or undesired activation or deactivation of light/electrical switches. Relevant examples of prior art devices developed in an attempt to achieve this goal can be seen in the following patents:

(1) U.S. Pat. No. 2,141,936 for a "Switch Handle Guard" issued Dec. 27, 1938, to R. H. Schmitt, describing a system for use with a typical toggle type light/electrical switch featuring stationary tabs blocking side access to the switch.

(2) U.S. Pat. No. D301,336 for a "Light Switch Protective Shield" issued May 30, 1989, to A. Eugene Copeland, describing a system for use with a typical toggle type light/electrical switch featuring a simple bracket fastening at either end to the screws securing the plate of the switch and extending over the switch so as to block frontal access, but not blocking side access to the switch.

(3) U.S. Pat. No. Des. 314,556 for a "Switch Guard" issued Feb. 12, 1991, to Robert D. Aggson, describing a system for use with a typical toggle type light/electrical switch featuring a box like structure fastened to the plate via the screws securing the plate of the switch and surrounding/covering the switch, but with a frontal lid/door that can be opened to provide frontal access to the switch.

(4) U.S. Pat. No. Des. 324,816 for a "Protective Cover for Electrical Switches or Sockets" issued Mar. 24, 1992, to Paul J. LeDuc, describing a system for use with a typical toggle type light/electrical switch featuring a cover snapping onto features of the electrical box housing the switch.

(5) U.S. Pat. No. Des. 408,018 for a "Switch Guard" issued Apr. 13, 1999 to Patrick J. McNaughton, like the patent cited in (2), above, describes a system for use with a typical toggle type light/electrical switch featuring a simple bracket fastening at either end to the screws securing the plate of the switch and extending over the switch so as to block frontal access, but not blocking side access to the switch.

(6) U.S. Pat. No. 5,955,702 for an "Electrical Switch Protective Cover" issued Sep. 21, 1999, to M. Gary Grossman et al., describing a system for use with a typical toggle type light/electrical switch featuring a stationary frame for fastening to the switch plate with a moveable frame with a toggle cover hingeably connected thereto so as to block access to the switch when closed, but able to be opened so as to allow access to the switch (7) U.S. Pat. No. D450,663 for a "Switch Guard" issued Nov. 20, 2001, to Tim Smith, describing a system for use with a typical toggle type light/electrical switch featuring a switch cover that can be fastened to the switch plate via the screws securing the plate of the switch and extending over the switch so as to block side and frontal access to the switch.

(8) U.S. Pat. No. D466,870 for a "Light Switch Cover" issued Dec. 10, 2002, to Roberto H. Elliott, like the patent cited in (7), above, describes a system for use with a typical toggle type light/electrical switch featuring a switch cover that can be fastened to the switch plate via the screws securing the plate of the switch and extending over the switch so as to block side and frontal access to the switch.

(9) U.S. Pat. No. D507,476 for an "Electrical Switch Cover" issued Jul. 19, 2005, to Amir Zahedi et al., like the patent cited in (2), above, describes a system for apparent use with a rocker type light/electrical switch featuring a box structure fastening at either end to the screws securing the plate of the switch and extending over the switch so as to block frontal and side access.

(10) U.S. Pat. No. D514,922 for a "Electrical Switch Cover" issued Feb. 14, 2006, to Amir Zahedi et al., describes a system for apparent use with a toggle type light/electrical switch featuring a box structure fastening at either end to the screws securing the plate of the switch and extending over the switch so as to block frontal and side access.

However, there is a continuing need for devices providing new and improved features in the field of the invention. Further, there are no prior art devices possessing the unique features and advantages inherent in my invention.

SUMMARY OF THE INVENTION

The instant invention teaches a protective cover for an electrical switch forming part of an electrical circuit having three key components: a fastening flange adapted to be secured to a cover plate for the switch, a shield portion connected to the fastening flange which serves to block access to the electrical switch so as to prevent movement of the switch by a user, and a snap off tab forming part of the shield portion, with the snap off tab being adapted to be snapped off and removed to allow access to and movement of the electrical switch by a user. Because common electrical/light switches of the type used with the invention typically take the form of either a toggle switch or a rocker switch, two different embodiments are described adapted for use with each of these forms of switch. Thus, the invention allows a degree of versatility not previously available in devices of this type, as it comes in a form that does not allow access, but can be quickly changed (by a simple snap or two) into a form that can allow limited or more complete access for use of the switch. It can be easily and simply molded from suitable plastic materials in accordance with known teachings in the art, and is preferably formed from transparent plastics so as to blend with the color of the switch being covered. It also provides numerous other advantages, which will be more fully understood after review of the drawings and detailed description that follows.

DESCRIPTION

The instant invention comprises a protective cover for an electrical switch having three key components. First, fastening flanges adapted to be secured to a cover plate for the switch. Fastening flanges will generally take the form of tabs or planar member(s) forming part of the cover and capable of lying flat against the cover plate. The flange could potentially be provided with an adhesive pad having a peel away cover strip, or connected to the cover plate in some other way known in the art, but in the embodiments discussed herein, flanges are adapted for use with a screw as further discussed below. Second, a shield portion is connected to the fastening flange(s) and serves to block access to the electrical switch so as to prevent movement of the switch by a user. Third, a snap off tab or tabs forms part of the shield portion, with the snap off tab(s) being adapted (by inclusion of a snap groove at its/their juncture(s) with the shield portion) to be snapped off and removed to allow access to and movement of the electrical switch by a user. Because common electrical/light switches of the type used with the invention typically take the form of either a toggle switch or a rocker switch, two different embodiments are described for use with each of these forms of switch. The foregoing components will be identified, denoted and discussed with respect to each of these embodiments in the discussion which follows. The invention can be made from any number of materials, but it is preferably produced from a clear plastic such as ABS or polycarbonate via an injection molding process of the type well known in the mechanical arts.

Figure 1:
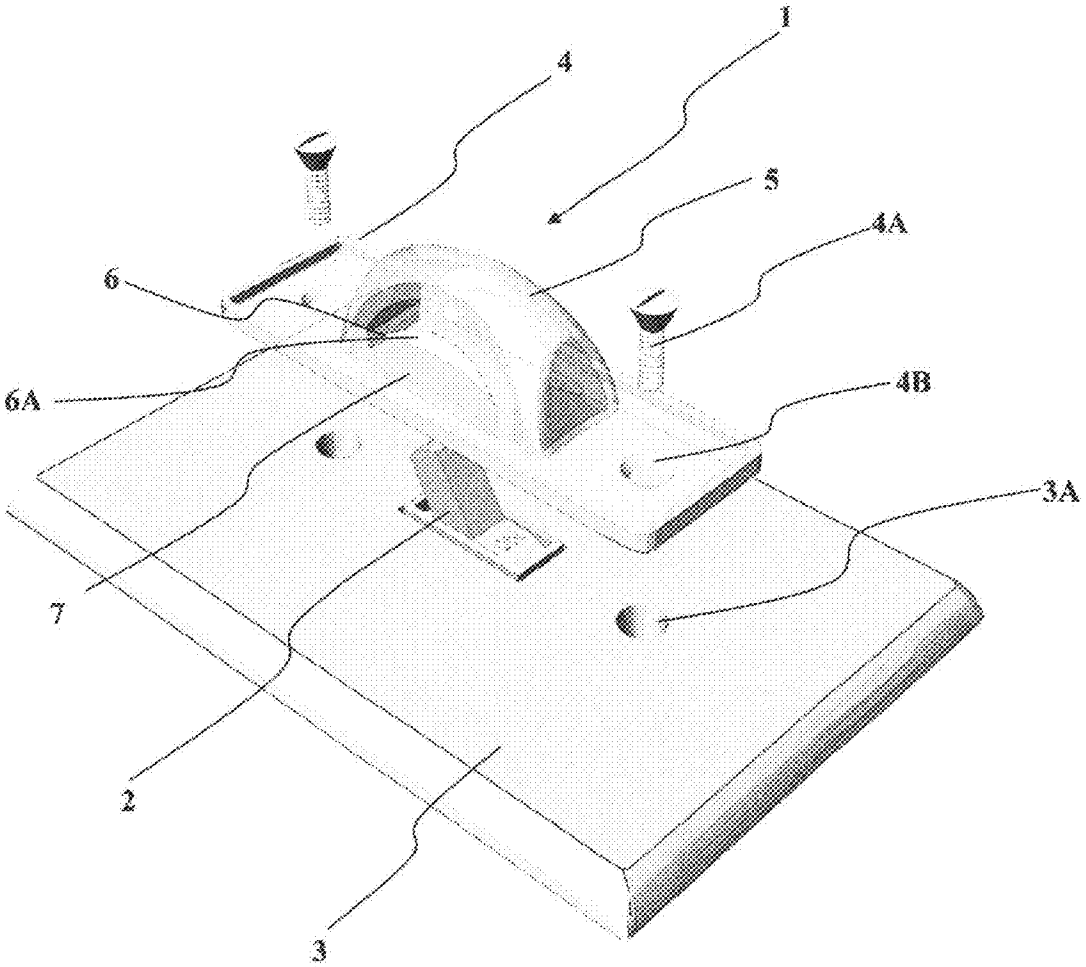
FIG. 1 provides a schematic perspective view of a first embodiment of the protective switch cover of the invention positioned in spaced relationship to a typical toggle type light/electrical switch.
Figure 2:
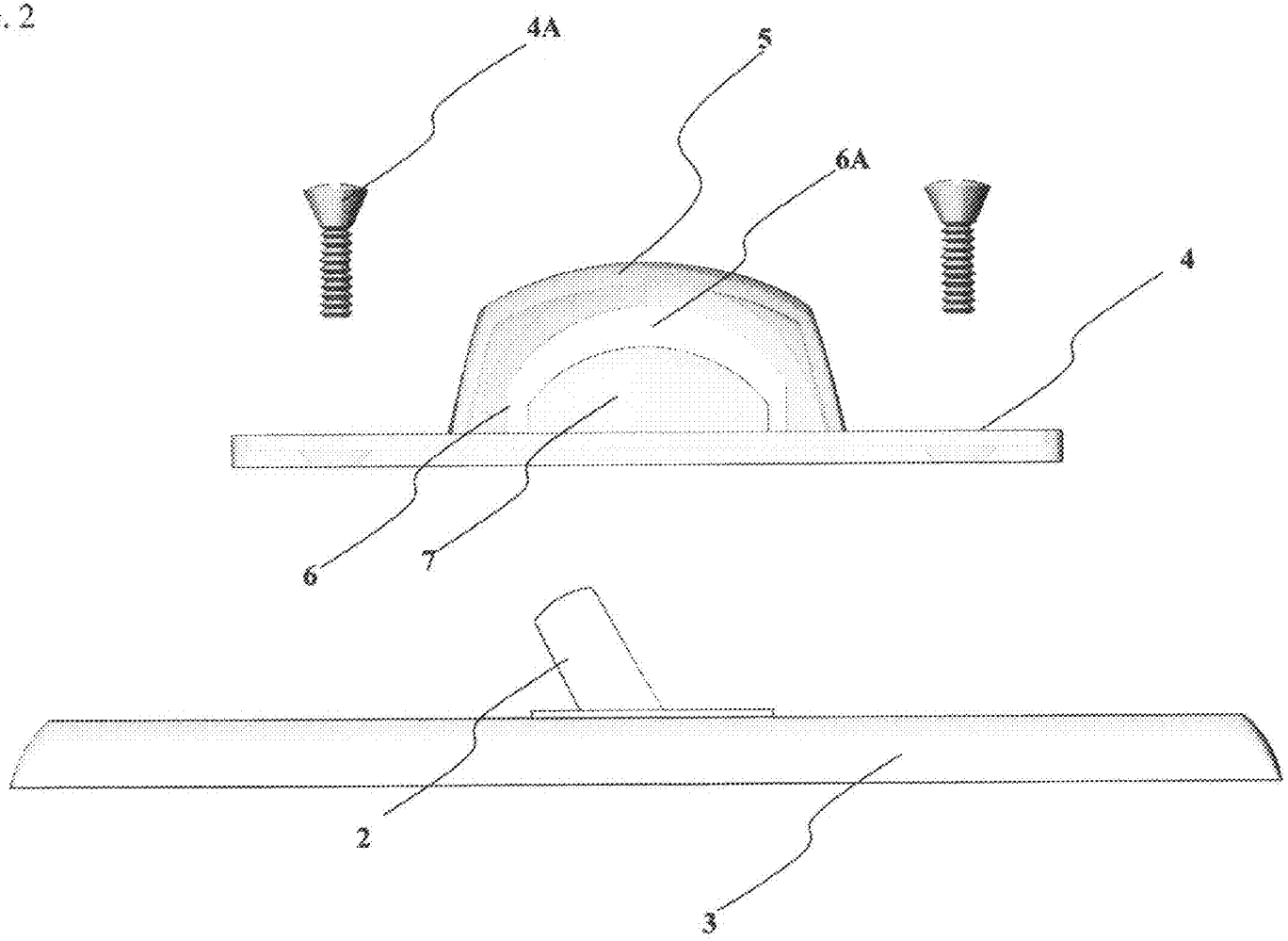
FIG. 2 provides a schematic side view of the first embodiment of the protective switch cover of the invention positioned in spaced relationship to the switch.
Figure 3:
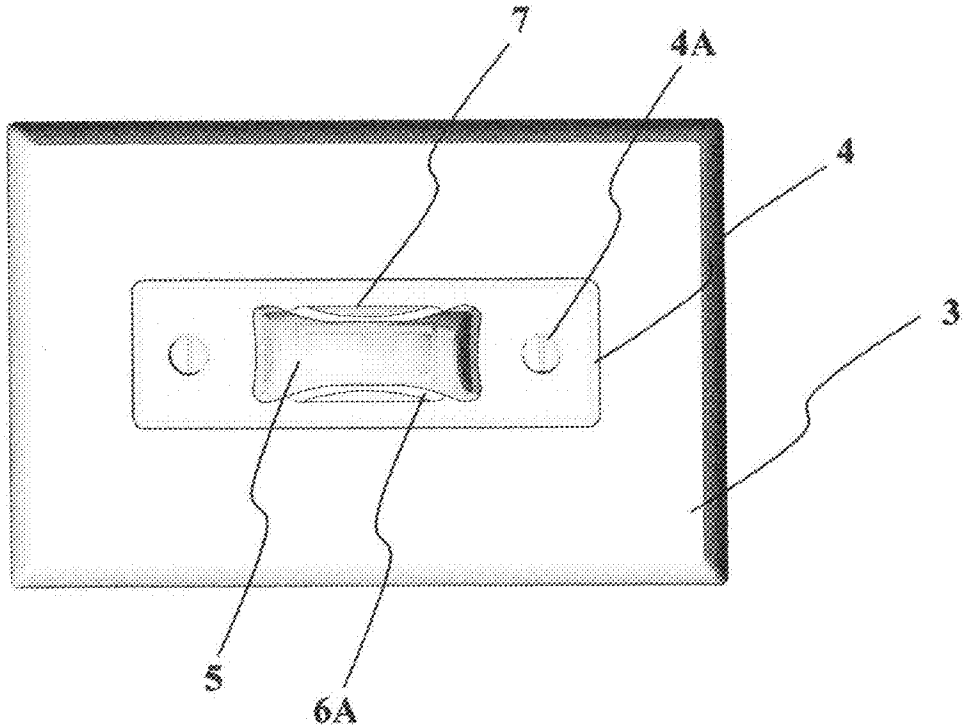
FIG. 3 provides a schematic front view of the first embodiment of the protective switch cover of the invention positioned and affixed to the switch.
Figure 4:
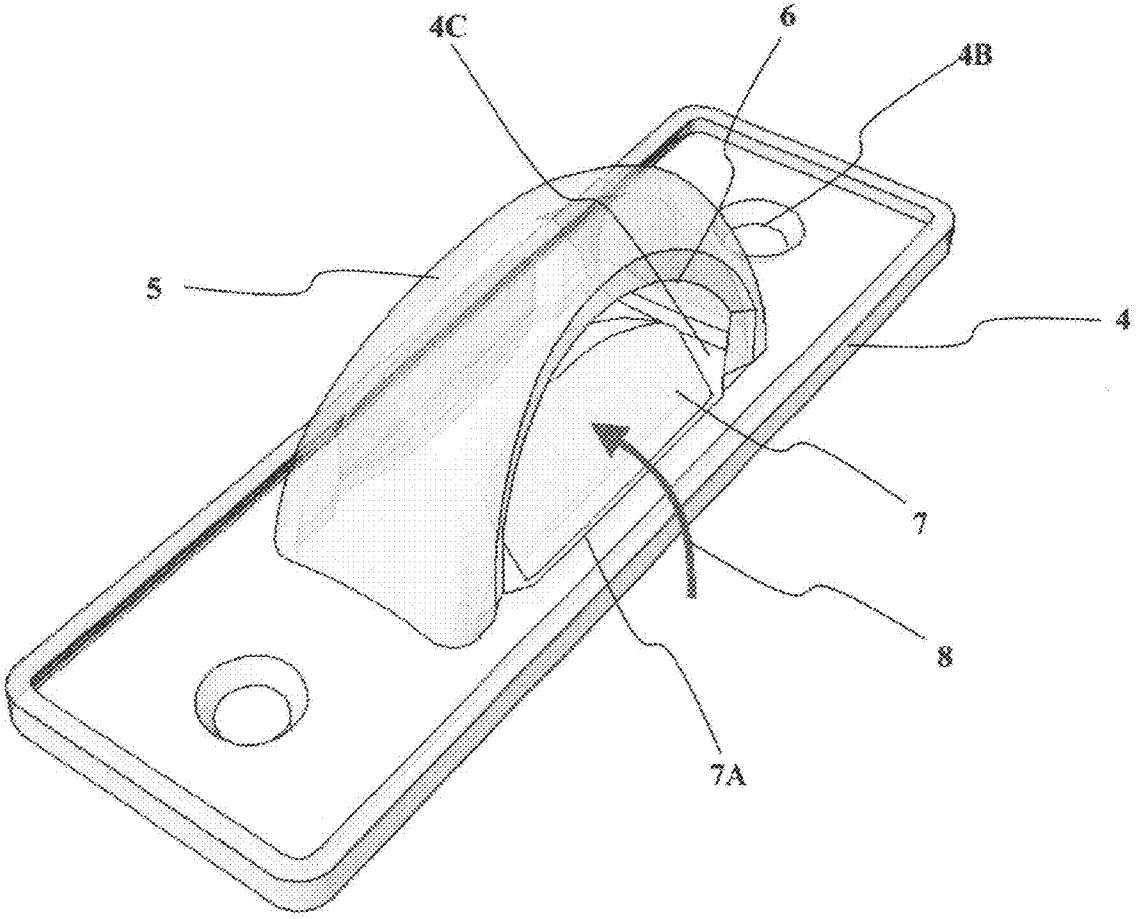
FIG. 4 provides a schematic perspective view of the first embodiment of the protective switch cover of the invention, showing one of its removable side portions in the process of being deflected and snapped off.
Figure 5:
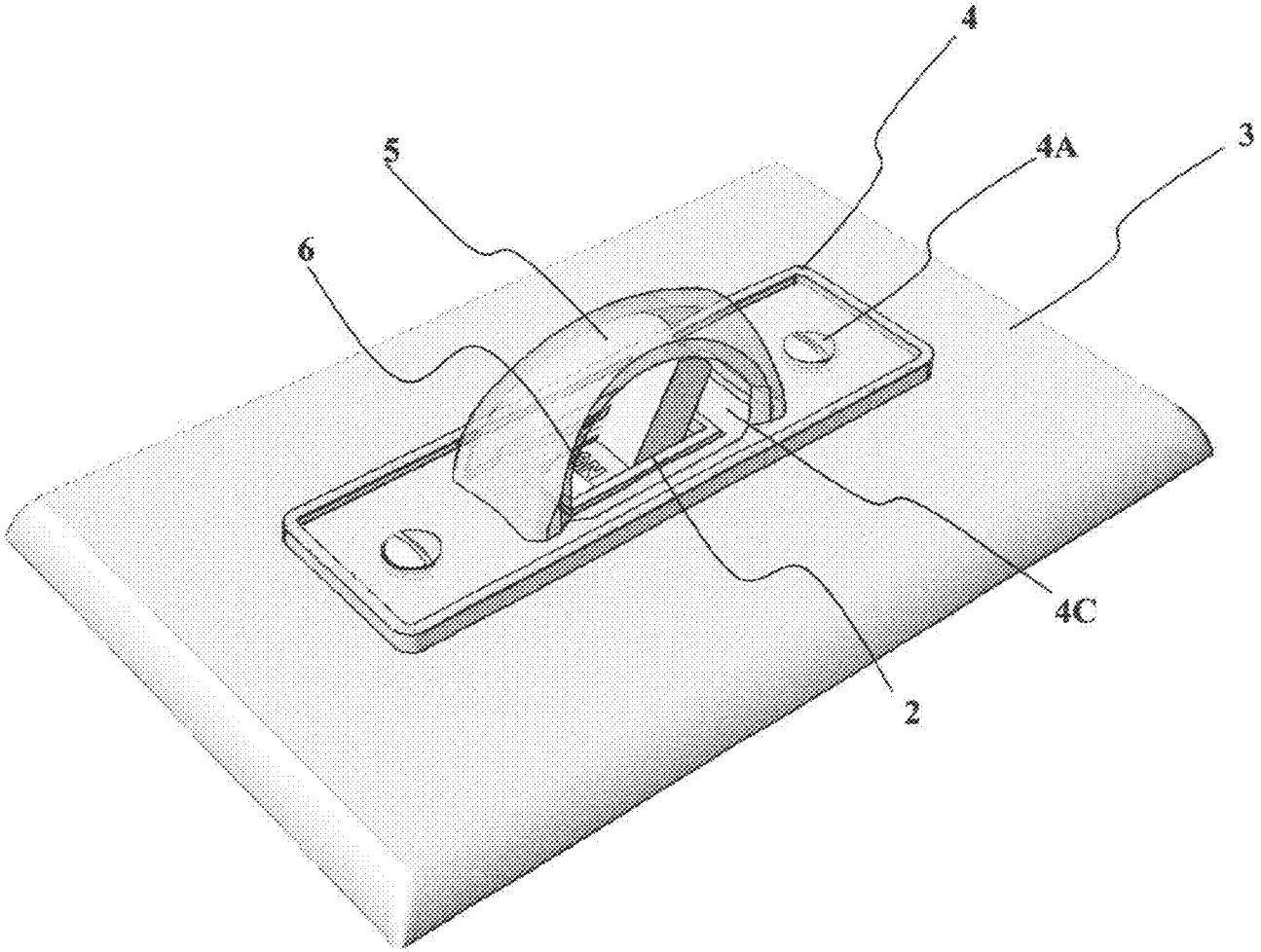
FIG. 5 provides a schematic perspective view of the first embodiment of the protective switch cover of the invention positioned and affixed to the switch after both of its removable side portions have been snapped off and removed.
Figure 6:
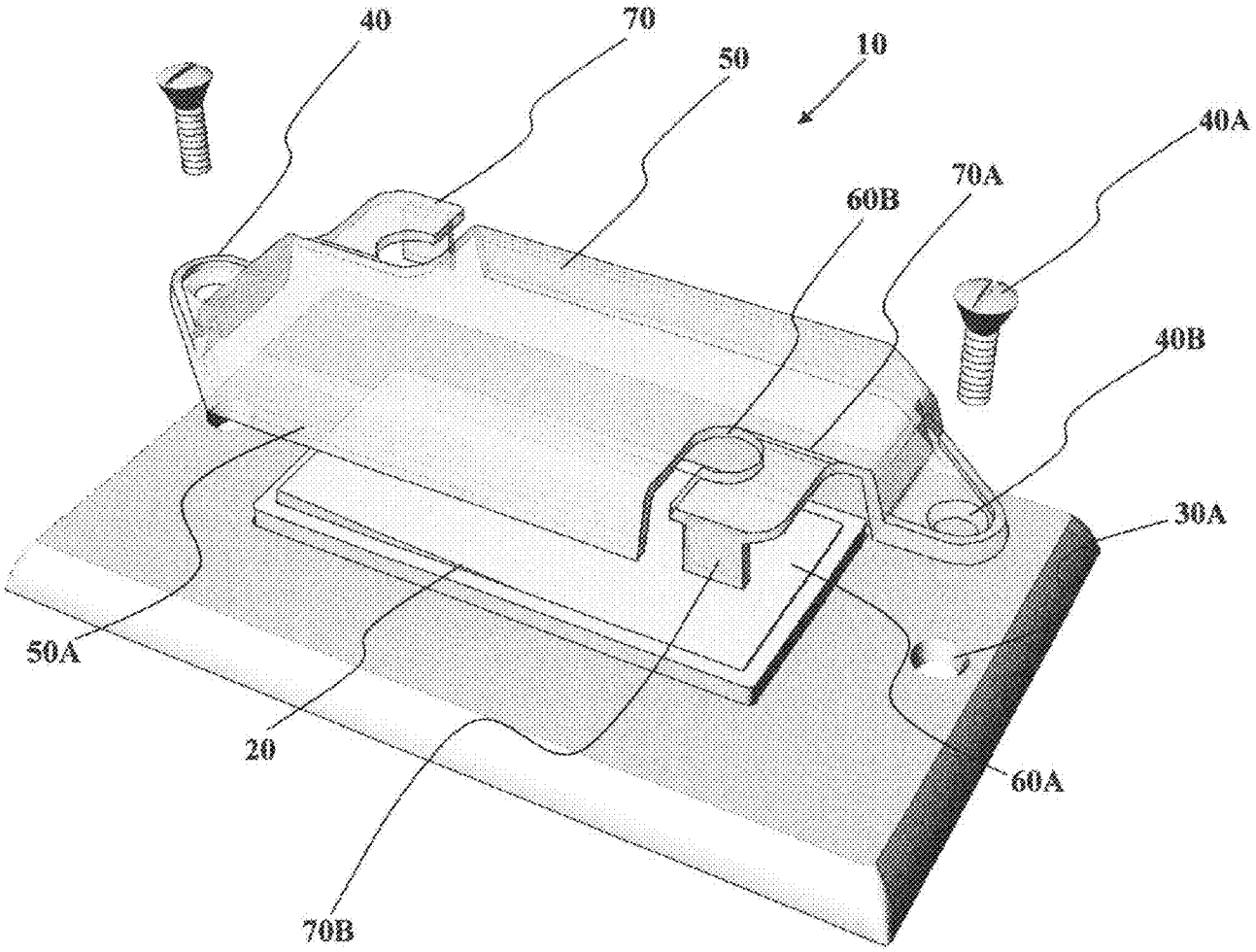
FIG. 6 provides a schematic perspective view of a second embodiment of the protective switch cover of the invention positioned in spaced relationship to a typical rocker type light/electrical switch.
Figure 7:
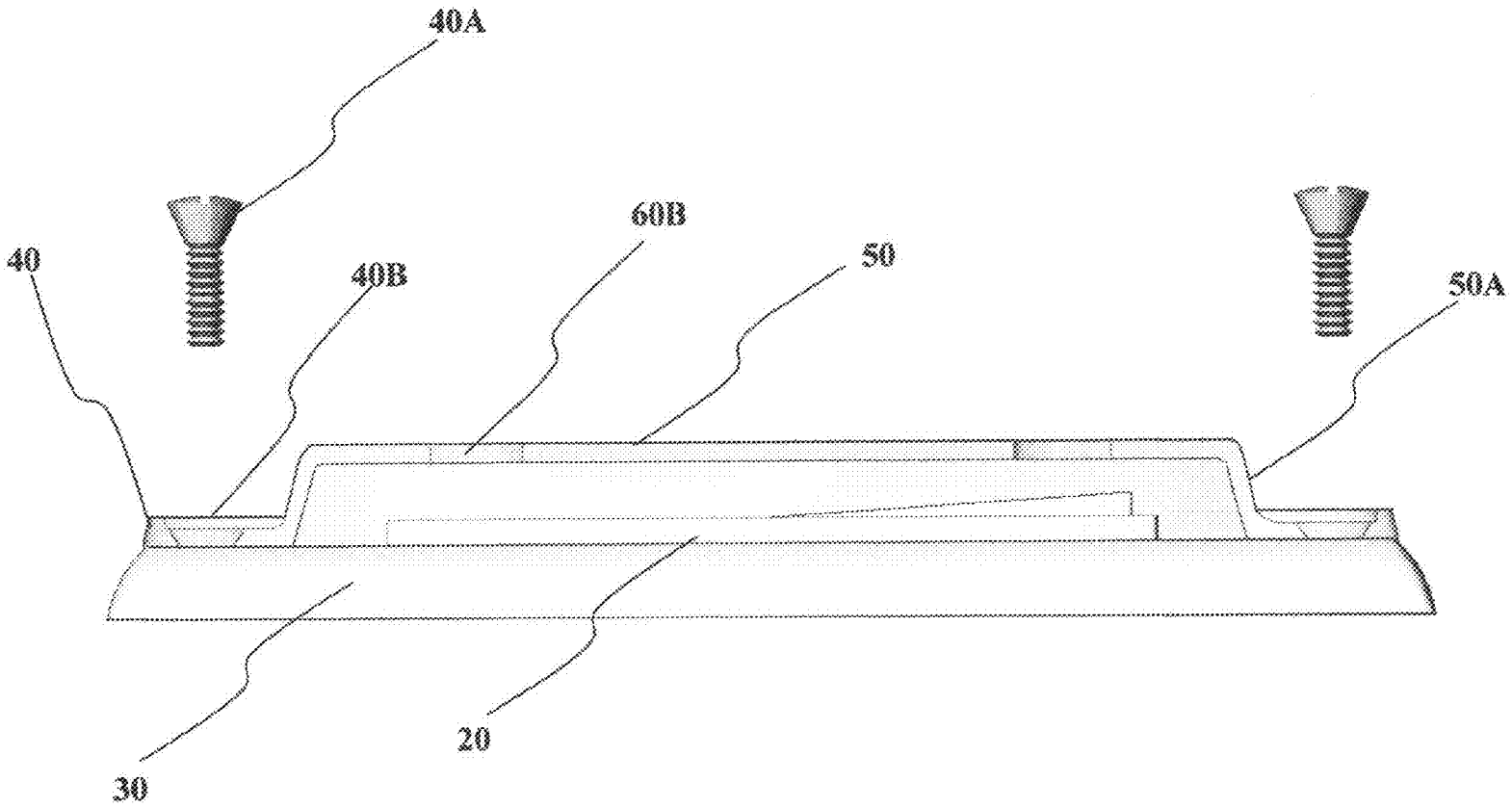
FIG. 7 provides a schematic side view of the second embodiment of the protective switch cover of the invention properly positioned adjacent the switch.

The basic concepts and principles governing my invention, as outlined above, can be more tangibly understood and derived from review of FIGS. 1 through 5, where subparts are appropriately referenced and numbered. (Not all subparts are numbered in each drawing figures to avoid overcrowding and confusion). These figures provide views of a first embodiment of the protective switch cover (denoted generally by arrow 1) of the invention adapted for use with a typical toggle type light/electrical switch 2 and plate 3 combination. As will be noted, the toggle switch cover 1 is provided with a flange member in the form of base 4 (adapted for placement adjacent plate 3), and can be fastened thereto via placement of screws 4A through base screw holes 4B and plate screw holes 3A (as illustrated in FIGS. 3 and 5). An appropriately shaped and placed switch opening 4C allows switch 2 to project through base 4 into and under arcuate shield portion 5 when base 4 is positioned adjacent plate 3. The arcuate shield portion 5 extends from base 4 over opening 4C and provides coverage blocking manipulation or contact with switch 2. Side openings 6 are provided in shield portion 5, but these are initially covered by removable side tabs 7 that block side access to switch 2 unless or until these are removed by a user. Removable side tabs 7 could be sized to completely block side openings 6; however, it is preferred to provide limited access by appropriate tool (if the device is to be used as a strong deterrent to switch activation) without removing side tabs 7 by leaving a slight gap 6A. More complete access, particularly manual access for direct manipulation by hand, can then be obtained by snapping off either or both side tabs 7 so as to completely uncover side opening(s) 6. For this purpose, molded snap grooves 7A are provided where tabs 7 are joined to base 4, allowing one or both of said tabs to be snapped loose prior to installation of the device if its intended use involves or requires easier access, or the device is to act only as a mild deterrent to manual activation. Once either or both tabs 7 are removed, the arcuate shape and positioning of shield portion 5 allow the toggle switch 2 to be flipped between its alternate on/off positions without interference.

Further clarification in terms of the deployment and use of the invention may be achieved by considering FIGS. 1 through 5 in the order presented. From this standpoint, as will be seen in FIGS. 1 and 2, it is initially desirable to remove screws 4A from plate screw holes 3A and arrange the cover 1 in appropriate position proximate plate 3 and switch 2. After this, cover 1 is placed adjacent plate 3 so as to cover switch 2, and fastened thereto via placement of screws 4A through base screw holes 4B and plate screw holes 3A, so as to be firmly affixed thereto (as illustrated in FIG. 3). If full access to switch 2 from either or both sides is desired, either or both removable side tabs 7 (as appropriate) can be snapped free via rotation around respective adjacent snap groove(s) 7A (before the device is installed), as best seen in FIG. 4. (This operation could also take after fastening a cover 1 in position, but would require the cover 1 to be temporarily removed in order to remove a side tab or tabs 7, and then refastened in position). Where both removable tabs 7 are snapped loose, the configuration will be that shown in FIG. 5, where side openings 6 are clear, allowing manual access to switch 2 from either or both sides, but still blocking direct frontal access and providing a safety cover for the switch preventing accidental contact and/or activation/deactivation.

Figure 10:
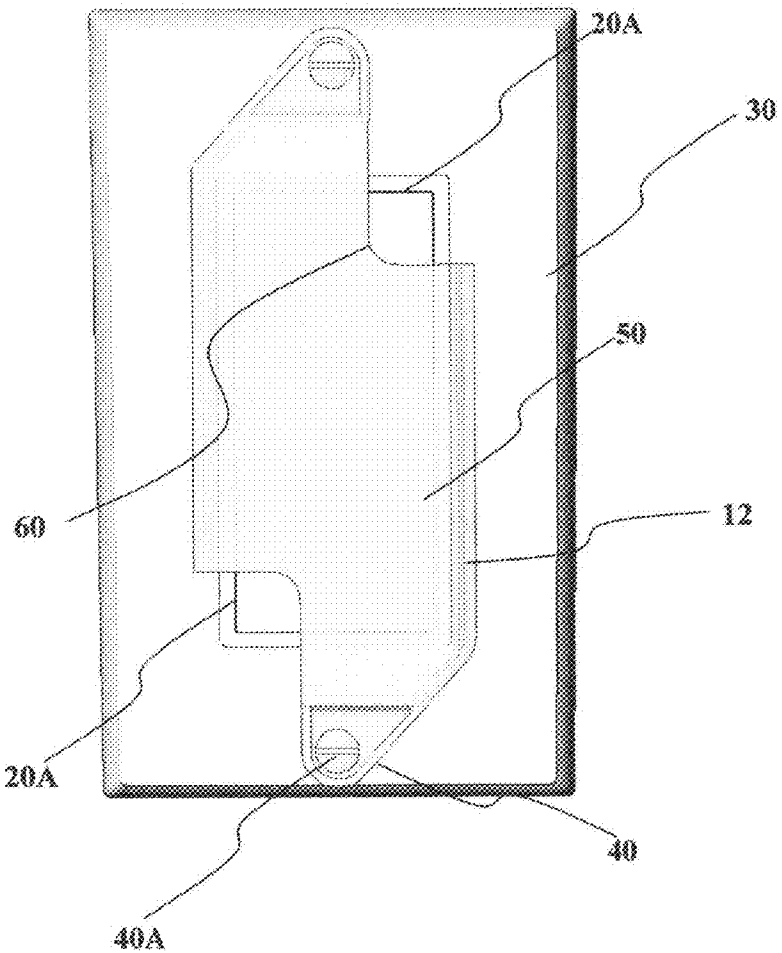
FIG. 10 provides a schematic front view of the second embodiment of the protective switch cover of the invention property positioned adjacent the switch after both of its removable corner portions have been snapped off and removed.

A second embodiment of the protective rocker switch cover (denoted generally by arrow 10) of the invention adapted for use with a typical rocker type light/electrical switch 20 and plate 30 combination is illustrated in FIGS. 6 through 10. (Once again, not all subparts are numbered in each of these drawing figures to avoid overcrowding and confusion). As will be noted, the rocker switch cover 10 in this embodiment has distinctive modifications to suit it for use with this type of switch. First, due to the different nature and shape of the rocker switch 20, its shield portion 50 has a much broader and flatter shape overall. Second, shield portion 50 does not possess the distinctive base 4 of toggle switch cover 1, instead its flange portion takes a more de minimis form as screw tabs 40 attached to shield portion 50. The flattened shield portion 50 of this embodiment is, after placement, supported in spaced relationship to rocker plate 30 by transverse side walls 50A having exposed edges 50B that are adapted for placement abutting rocker plate 30 so as to assist in supporting shield portion 50 in proper position. Further support is provided by screw tabs 40, which are transverse to side walls 50A and adapted for placement adjacent rocker plate 30. Rocker switch cover 10 is fastened to rocker plate 30 via placement of screws 40A through rocker base screw holes 40B and plate screw holes 30A (as illustrated in FIG. 10).

In this embodiment, access to the broad flat rocker switch 20 is not provided via side snap off portions (like the removable tabs 7 previously discussed). Instead, removable corner tabs 70, can be snapped off in like manner to provide access so as to allow a user to manually push either end of the rocker switch 20 as necessary for activation/closing or deactivation/opening of an electrical circuit. Once again, for this purpose, molded snap grooves 70A are provided where corner tabs 70 are joined to shield portion 50, allowing one or both of said tabs to be snapped loose.

As in the prior embodiment, removable tabs 70 could be sized and configured so as to completely block corner openings 60; however, it is once again preferred to provide limited access without removing side tabs 70 by leaving side wall gaps 60A and top gaps 60B. Top gaps 60B are circular and allow easy use of a pencil or like object to depress alternate sides of the rocker switch 20 as needed. Side wall gaps 60A are also shaped for easy tool access. As in the previously discussed embodiment, more complete access, particularly manual access for direct manipulation by hand, can be obtained by snapping off either or both corner tabs 70 so as to completely uncover corner opening(s) 60. And, once again, when said tabs 70 are removed, the shape and positioning of shield portion 50 allow the rocker switch 20 to be flipped between its alternate on/off positions without interference. (A further refinement is the inclusion of a support member 70B—which also serves as an extension of side wall 50A—to support a tab 70 before its removal, preventing simple depression of said tab 70 (whether accidental or intentional) to flip switch 20 without complete removal thereof).

Figure 8:
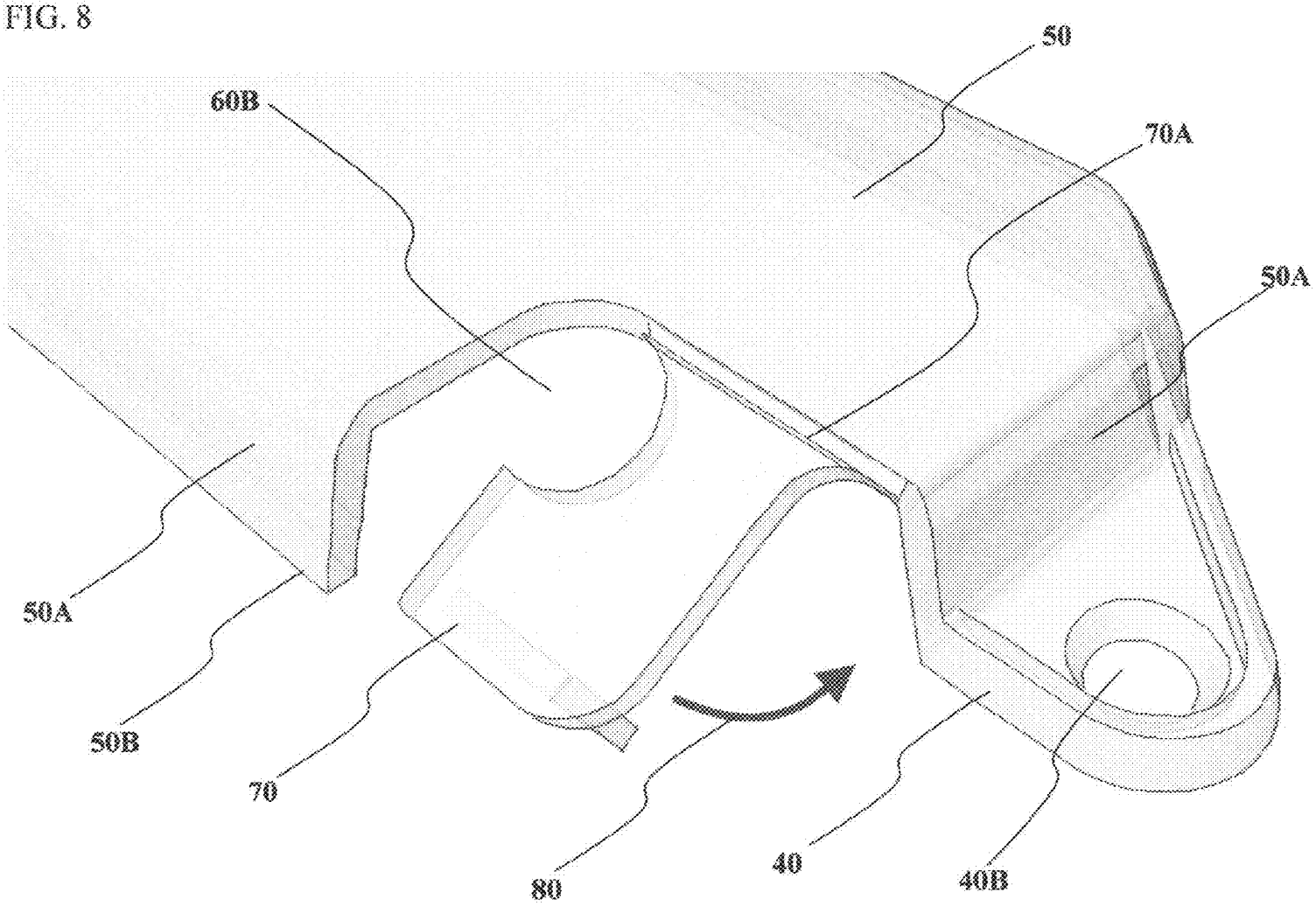
FIG. 8 provides a schematic perspective view of a corner portion of the second embodiment of the protective switch cover of the invention, showing one of its removable corner portions in the process of being deflected and snapped off.
Figure 9:
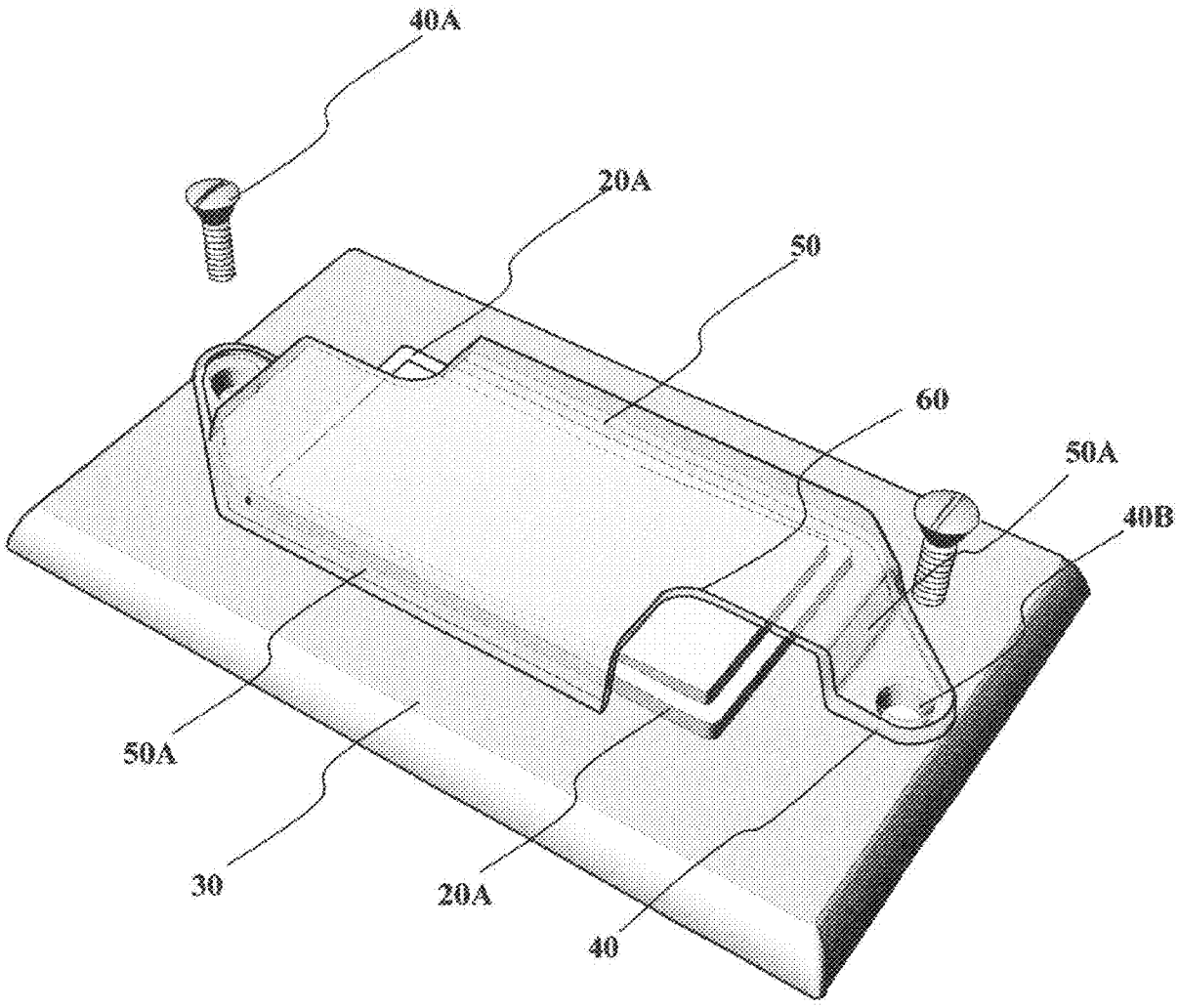
FIG. 9 provides a schematic perspective view of the second embodiment of the protective switch cover of the invention properly positioned adjacent the switch after both of its removable corner portions have been snapped off and removed.

Further clarification in terms of the deployment and use of this embodiment of the invention may be achieved by considering FIGS. 6 through 10. As will be seen in FIGS. 6 and 7, it is initially desirable to remove screws 40A from plate screw holes 30A and arrange rocker switch cover 10 in appropriate position proximate plate 30 and switch 20. After this, cover 10 is placed adjacent plate 30 so as to cover switch 20, and fastened thereto via placement of screws 40A through base screw holes 40B and plate screw holes 30A, so as to be firmly affixed thereto (as illustrated in FIG. 10). If access to switch 2 is desired, either or both removable corner tabs 70 (as appropriate) can be snapped free via rotation around respective adjacent snap groove(s) 70A, as best seen in FIG. 8. (This operation should, as discussed in reference to the first embodiment, take place before fastening cover 10 in position). Where both removable tabs 70 are snapped loose, the configuration will be that shown in FIGS. 9 and 10, where both corner openings 60 are clear, allowing access to switch 20 from both corners, but still blocking most direct frontal access and providing a safety cover for the switch which helps to prevent accidental contact and/or activation/deactivation. It will normally be necessary to remove both corner tabs for complete on/off manual access due to the structure of rocker switch 20.

PARTS AND FEATURES ILLUSTRATED IN DRAWING FIGURES

1 toggle switch cover
2 toggle type light/electrical switch
3 toggle type light/electrical switch plate
  3A toggle switch plate screw holes
4 toggle switch cover base
  4A screws
  4B toggle switch cover base screw holes
  4C opening in toggle switch cover base
5 toggle switch cover shield portion
6 toggle switch cover shield side openings
  6A toggle switch cover shield gaps
7 removable toggle switch cover shield side tabs
  7A snap grooves for toggle switch cover shield side tabs
8 arrow showing side shield tab movement
10 rocker switch cover
20 rocker type light/electrical switch
  20A exposed corner of rocker type light/electrical switch
30 rocker type light/electrical switch plate
  30A rocker switch plate screw holes
40 rocker switch cover screw tabs
  40A screws
  40B rocker switch cover screw holes
  40C switch opening
50 rocker switch cover shield portion
  50A rocker switch cover shield side walls
  50B rocker switch cover shield side wall edges
60 rocker switch cover shield corner openings
  60A rocker switch cover shield side wall gaps
  60B rocker switch cover shield top gaps
70 removable rocker switch cover shield corner tabs
  70A snap grooves for rocker switch cover shield corner tabs
  70B rocker switch cover shield corner tab support member
80 arrow showing cover shield corner tab movement In view of the foregoing, it should be clear that numerous changes and variations can be made without exceeding the scope of the inventive concept outlined. Accordingly, it is to be understood that the embodiment(s) of the invention herein described is/are merely illustrative of the application of the principles of the invention. Reference herein to details of the illustrated embodiment(s) is not intended to limit the scope of the claims, which will themselves recite those features regarded as essential to the invention.

I claim:

1. A protective cover for an electrical switch forming part of an electrical circuit, comprising:

a fastening flange adapted to be secured to a cover plate for said switch;

a shield portion connected to said fastening flange limiting access to said electrical switch;

at least one snap off tab, which snap off tab is adapted to be snapped off and removed to allow more access to said electrical switch; and wherein there is at least one gap in said shield allowing limited access to said electrical switch before said at least one snap off tab is removed, said gap extending between and separating said snap off tab from said shield portion.

2. The protective cover of claim 1, wherein said fastening flange is adapted to be attached to said cover plate using screws that also secure said plate adjacent said switch, said snap off tab is attached to and extends outwardly from said fastening flange, and there is at least one gap in said shield allowing limited access to said electrical switch before said at least one snap off tab is removed, said gap extending between and separating said snap off tab from said shield portion.

3. A protective cover for an electrical toggle switch forming part of an electrical circuit, comprising:

a fastening flange adapted to be secured to a cover plate for said toggle switch;

an arcuate shield portion shaped to allow said toggle switch to be flipped between activated and deactivated position connected to said fastening flange and limiting access to said electrical toggle switch; and at least one snap off side tab, which snap off side tab is adapted to be snapped off and removed by inclusion of a snap groove at its juncture with said fastening flange to allow side access to said electrical toggle switch.

4. The protective cover of claim 3, wherein said fastening flange forms a rectangular base member and is adapted to be attached to said cover plate using screws that also secure said plate adjacent said toggle switch, and said at least one snap off tab is attached to and extends outwardly from said fastening flange being adapted to snap off.

5. The protective cover of claim 4, wherein there is at least one gap in said shield adjacent said at least one tab allowing limited access to said electrical switch before said at least one side snap off tab is removed, said gap extending between and separating said snap off tab from said shield portion.

6. The protective cover of claim 3, wherein there is at least one gap in said shield adjacent said at least one tab allowing limited access to said electrical switch before said at least one side snap off tab is removed, said gap extending between and separating said snap off tab from said shield portion.

7. A protective cover for an electrical rocker switch forming part of an electrical circuit, comprising:

a fastening flange adapted to be secured to a cover plate for said rocker switch;

a flattened rectangular shield portion shaped to allow said rocker switch to be flipped between activated and deactivated position connected to said fastening flange and limiting access to said electrical rocker switch; and at least one snap off corner tab forming part of said shield portion, which snap off corner tab is adapted to be snapped off and removed to allow corner access to said electrical rocker switch.

8. The protective cover of claim 7, wherein said fastening flange is formed by at least one screw tab attached to said shield and adapted to be attached to said cover plate using screws that also secure said plate adjacent said rocker switch.

9. The protective cover of claim 8, wherein there is at least one gap in said shield adjacent said at least one snap off corner tab allowing limited access to said electrical switch before said at least one corner snap off tab is removed.

10. The protective cover of claim 9, wherein said shield includes a top and side walls, and said at least one gap includes at least one of a gap in said top and a gap in said side walls.

11. The protective cover of claim 10, wherein said at least one snap off corner tab further includes a support member extending between said tab and the plate.

12. The protective cover of claim 9, wherein said at least one snap off corner tab further includes a support member extending between said tab and the plate.

13. The protective cover of claim 8, wherein said at least one snap off corner tab further includes a support member extending between said tab and the plate.

14. The protective cover of claim 7, wherein there is at least one gap in said shield adjacent said at least one snap off corner tab allowing limited access to said electrical switch before said at least one corner snap off tab is removed.

15. The protective cover of claim 14, wherein said shield includes a top and side walls, and said at least one gap includes at least one of a gap in said top and a gap in said side walls.

16. The protective cover of claim 15, wherein said at least one snap off corner tab further includes a support member extending between said tab and the plate.

17. The protective cover of claim 14, wherein said at least one snap off corner tab further includes a support member extending between said tab and the plate.

18. The protective cover of claim 7, wherein said at least one snap off corner tab further includes a support member extending between said tab and the plate.

* * * * *